US011376461B2

(12) United States Patent
Li

(10) Patent No.: US 11,376,461 B2
(45) Date of Patent: Jul. 5, 2022

(54) FLYING RING FOR FITNESS EXERCISE AND A TRAINING APPARATUS INCLUDING THE SAME

(71) Applicant: Quanzhou Fengdong Sports Goods Co., Ltd, Quanzhou (CN)

(72) Inventor: Linlin Li, Quanzhou (CN)

( * ) Notice: Subject to any disclaimer, the term of this patent is extended or adjusted under 35 U.S.C. 154(b) by 0 days.

(21) Appl. No.: 17/121,784

(22) Filed: Dec. 15, 2020

(65) Prior Publication Data

US 2022/0134160 A1 May 5, 2022

(30) Foreign Application Priority Data

Oct. 29, 2020 (CN) ..... 202022455814.8

(51) Int. Cl.
*A63B 7/02* (2006.01)
*A63B 21/00* (2006.01)

(52) U.S. Cl.
CPC ..... *A63B 7/02* (2013.01); *A63B 21/4033* (2015.10); *A63B 2225/09* (2013.01)

(58) Field of Classification Search
CPC ... A63B 21/0442; A63B 7/02; A63B 21/0552; A63B 23/12; A63B 21/4035; A63B 23/03541; A63B 21/1627; A63B 21/4033; A63B 2225/09
See application file for complete search history.

(56) References Cited

U.S. PATENT DOCUMENTS 1,013,686 A * 1/1912 Reach ..... A63B 7/02 482/24
9,486,663 B2 * 11/2016 DeMarco ..... A63B 7/00
9,821,188 B2 * 11/2017 Dwork ..... A63B 7/02
2017/0296856 A1 * 10/2017 Burke ..... A63B 21/4019

FOREIGN PATENT DOCUMENTS

CN 202876190 U 4/2013

* cited by examiner

*Primary Examiner* — Andrew S Lo
*Assistant Examiner* — Andrew M Kobylarz

(57) ABSTRACT

A flying ring for fitness exercise is provided. The flying ring can support the feet or hands of the human body, is connected to an external belt, and is suspended to facilitate exercise activities of the user. The flying ring can be wound around an object for suspending to facilitate exercise activities of the human body, can be used in various exercise facilities, sufficiently meets the requirements for supporting the feet or hands of the human body, and is convenient to store. The present invention further provides a training apparatus including the flying ring. The training apparatus includes a ring body for supporting the feet or hands of the human body, and the upper part of the ring body is provided with a connecting device connected to the external belt.

16 Claims, 15 Drawing Sheets

FLYING RING FOR FITNESS EXERCISE AND A TRAINING APPARATUS INCLUDING THE SAME

CROSS REFERENCE TO THE RELATED APPLICATIONS

This application is based upon and claims priority to Chinese Patent Application No. 202022455814.8, filed on Oct. 29, 2020, the entire contents of which are incorporated herein by reference.

TECHNICAL FIELD

The present invention relates to the technical field of flying rings, and more particularly, to a flying ring for fitness exercise and a training apparatus including the same.

BACKGROUND

Chinese Patent No. 201220484645.3 discloses a length-adjustable flying ring for fitness exercise, which includes a nylon rope fixed on a tall object. One end of the nylon rope passes through a buckle ring and is fixed inside a movable buckle, and the other end of the nylon rope passes through the movable buckle and is fixedly connected to a flying ring grip. The nylon rope is attached to the flying ring grip by screws. This flying ring for fitness exercise is light, user-friendly, and is apt to use in various fitness facilities. Additionally, the flying ring grip has a simple structure and an adjustable height, which is easy to operate.

The aforementioned patent can solve the corresponding technical problems but still has the following shortcomings.

The flying ring for fitness exercise cannot be suspended since it lacks a component that allows the flying ring to be connected to an external belt. This causes an inconvenience to the user when exercising.

The training apparatus only has one ring body and thus is insufficient to meet the requirements for supporting the feet or hands of the human body. Additionally, the ring body cannot be installed on the belt, and therefore is awkward to store the ring body properly. The belt cannot be wound around an object for suspending, which limits how the human body can exercise and limits to where it can be used, like in particular exercise facilities only.

SUMMARY

Aiming at the shortcomings and deficiencies of the prior art, an objective of the present invention is to provide a flying ring for fitness exercise, which can support the feet or hands of the human body, is connected to an external belt, and is suspended to facilitate the exercise experience of the user. The flying ring can be wound around an object for suspending to facilitate exercise activities of the human body, and can be used in various exercise facilities, requirements for supporting the feet or hands of the human body are sufficiently met, and the flying ring can be conveniently stored. The present invention further provides a training apparatus including the flying ring.

In order to achieve the above-mentioned objective, the present invention adopts the following technical solutions.

A flying ring for fitness exercise includes a ring body for supporting the feet or hands of a human body, and the upper part of the ring body is provided with a connecting device connected to an external belt.

Further, a supporting device for supporting the feet or hands of the exerciser is detachably arranged on the inner ring of the ring body.

Further, the supporting device includes a supporting plate for supporting the feet or hands of the human body, and the supporting plate is provided with a clamping part connected to the inner ring of the ring body.

Further, each of the left side, the right side and the lower side of the supporting plate is provided with the clamping part.

Further, the supporting plate is a flat plate or a downwardly concave arc-shaped supporting plate or an upwardly convex arc-shaped supporting plate.

Further, an anti-slip part is provided on the surface of the supporting plate.

Further, the connecting device includes an adjusting frame arranged on the ring body and configured for the external belt to pass therethrough, and a limiting rod movably arranged on the adjusting frame and configured to limit the external belt with an adjusted length.

Further, each of both sides of the limiting rod is provided with a U-shaped sliding groove or a sliding protrusion, and the limiting rod is slidably arranged on the adjusting frame through the U-shaped sliding groove or the sliding protrusion on both sides.

Further, the limiting rod is provided with limiting teeth for retaining the adjusted belt.

Further, the lower part of the adjusting frame is threadedly connected to the upper part of the ring body through a bolt.

Based on the same concept of the present invention, the present invention further provides a training apparatus, including two ring bodies for supporting the feet or hands of the human body and a belt, and the ring bodies are detachably arranged at both ends of the belt.

Further, a supporting device for supporting the feet or hands of the exerciser is detachably arranged on the inner ring of the ring body.

Further, the supporting device includes a supporting plate for supporting the feet or hands of the human body, and the supporting plate is provided with a clamping part connected to the inner ring of the ring body.

Further, each of the left side, the right side and the lower side of the supporting plate is provided with the clamping part.

Further, the supporting plate is a flat plate or a downwardly concave arc-shaped supporting plate or an upwardly convex arc-shaped supporting plate.

Further, an anti-slip part is provided on the surface of the supporting plate.

Further, the ring bodies are detachably arranged at both ends of the belt through a connecting device. The connecting device includes an adjusting frame arranged on the ring body and configured for the belt to pass therethrough, and a limiting rod movably arranged on the adjusting frame and configured to limit the belt with an adjusted length.

Further, each of both sides of the limiting rod is provided with a U-shaped sliding groove or a sliding protrusion, and the limiting rod is slidably arranged on the adjusting frame through the U-shaped sliding groove or the sliding protrusion on both sides.

Further, the limiting rod is provided with limiting teeth for retaining the adjusted belt.

Further, the lower part of the adjusting frame is threadedly connected to the upper part of the ring body through a bolt.

Further, each of the ends of the belt is bent to form a limiting end, the limiting end is sewn with the belt, and a clamping edge for clamping the upper part of the adjusting frame is formed between the end of the limiting end and the belt.

Based on the same concept of the present invention, the present invention further provides a supporting device arranged on the flying ring for fitness exercise. The supporting device includes a supporting plate for supporting the feet or hands of the human body, and the supporting plate is provided with a clamping part connected to the inner ring of the ring body.

Further, each of the left side, the right side and the lower side of the supporting plate is provided with the clamping part.

Further, an anti-slip part is provided on the surface of the supporting plate.

Further, the supporting plate is a flat plate or a downwardly concave arc-shaped supporting plate or an upwardly convex arc-shaped supporting plate.

By adopting the above technical solutions, the present invention has the following advantages. The ring bodies can support the feet or hands of the human body, and the upper part of the ring body is provided with a connecting device connected to the external belt, so that the flying ring can be suspended to facilitate exercise activities of users.

The belt can be wound around an object for suspending, which is convenient for the human body to exercise and can be used in various exercise facilities. The two ring bodies sufficiently meet the requirements for supporting the feet or hands of the human body, and the two ring bodies are detachably arranged on the belt for convenient storage.

The supporting plate is configured to support the feet or hands of the human body and the clamping part facilitates the assembly and disassembly of the supporting plate on the inner ring of the ring body for convenient storage.

Further, each of the left side, the right side and the lower side of the supporting plate is provided with the clamping part to increase the stability of the supporting plate and the inner ring of the ring body.

Further, the supporting plate has different shapes to meet different supporting requirements.

Further, when the supporting plate supports the feet or hands of the exerciser, the anti-slip part can increase the friction between the feet or hands of the exerciser and the supporting plate, thus avoiding slippage.

Further, the limiting rod can limit the adjusted belt to increase the stability of the belt during use, thus preventing the belt from moving or loosening.

BRIEF DESCRIPTION OF THE DRAWINGS

In order to comprehensibly describe the technical solutions in the embodiments of the present invention or the prior art, the drawings used in the description of the embodiments or the prior art will be briefly introduced below. Obviously, the drawings in the following description are only some embodiments of the present invention. For those of ordinary skill in the art, other drawings can be obtained based on these drawings without creative efforts.

DETAILED DESCRIPTION OF THE EMBODIMENTS

The present invention is further described with reference to the drawings and specific embodiments.

Figure 1:
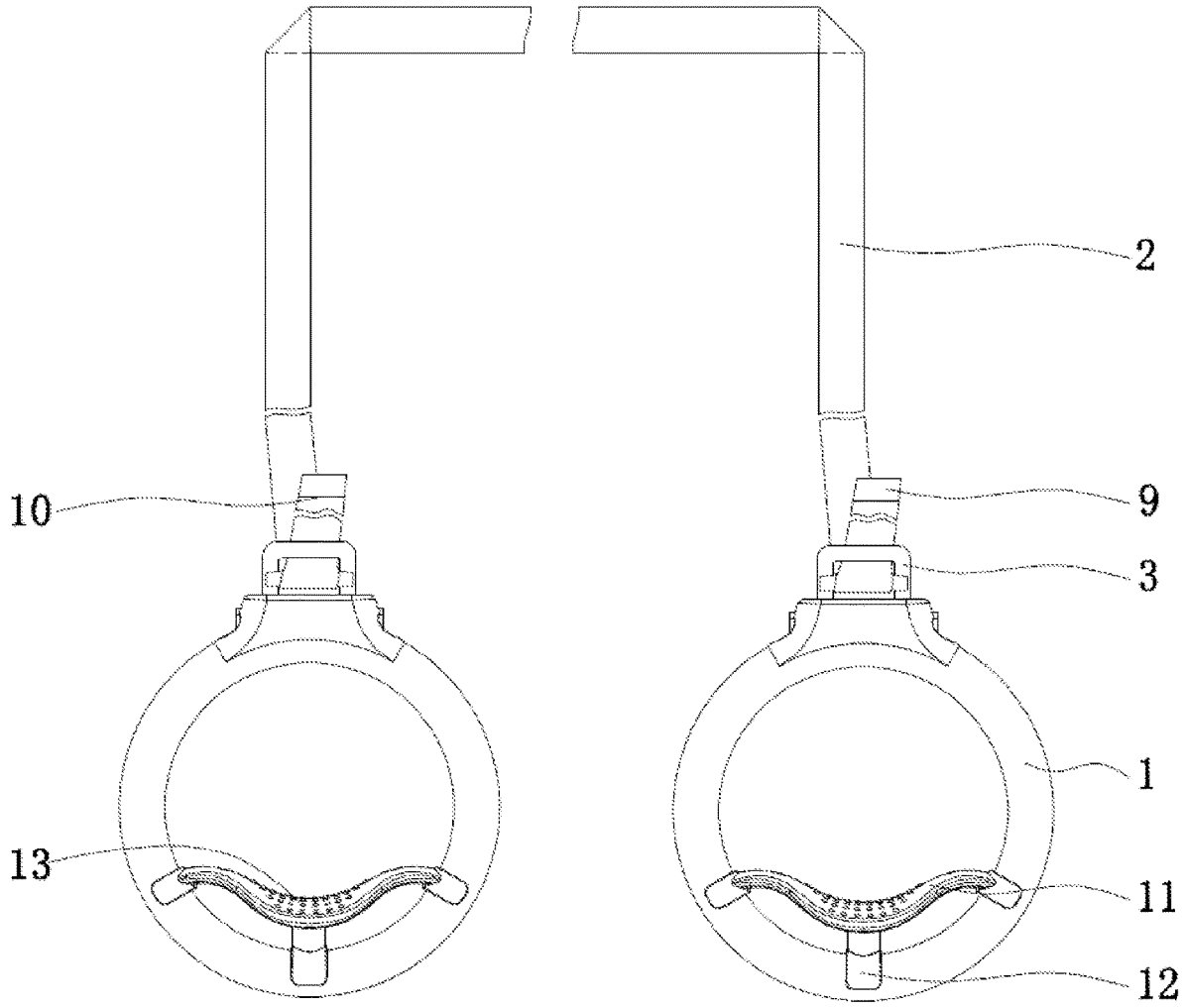
FIG. 1 is a structural schematic diagram of the present invention.
Figure 2:
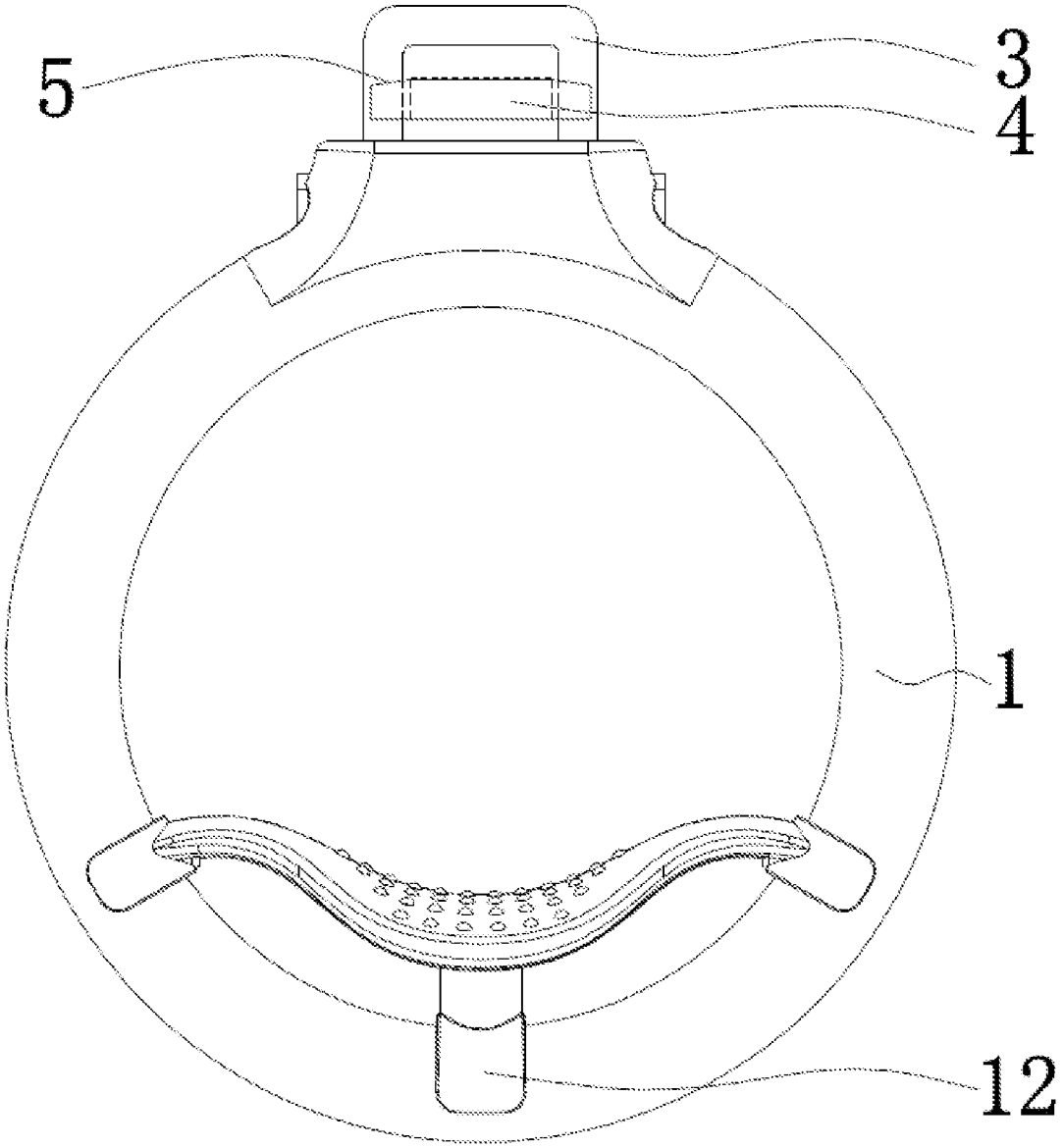
FIG. 2 is a structural schematic diagram of a ring body of FIG. 1 without the belt.
Figure 3:
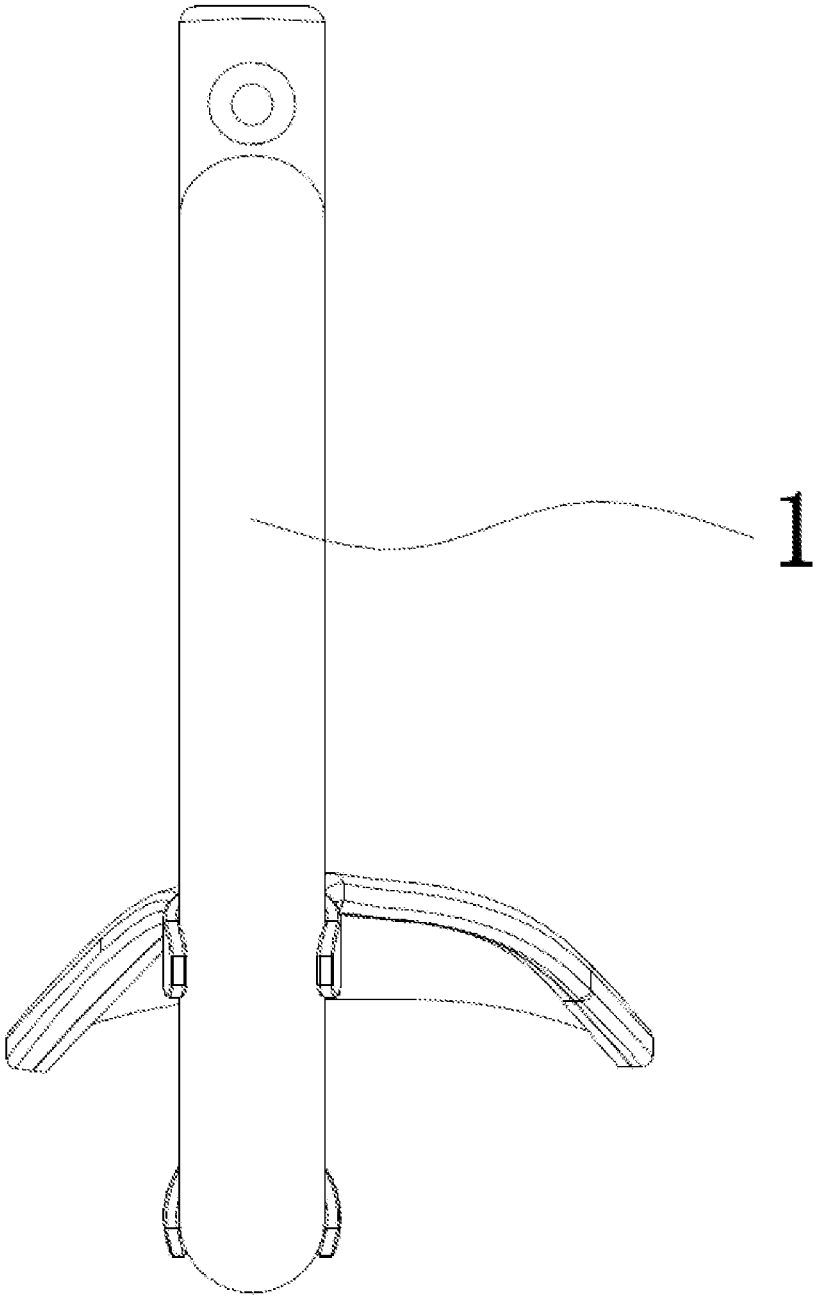
FIG. 3 is a right side view of FIG. 2 with the connecting device not shown.
Figure 4:
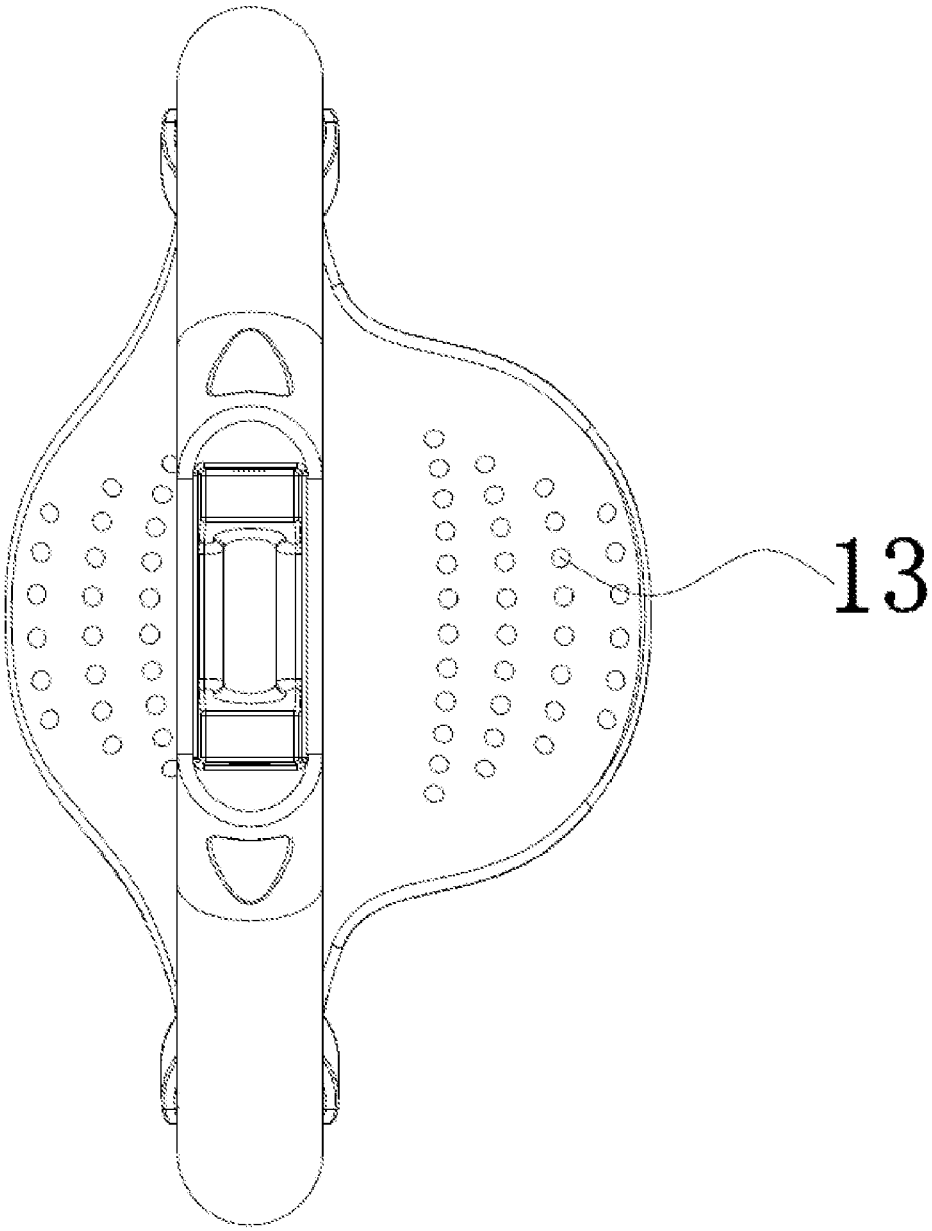
FIG. 4 is a top view of FIG. 3.
Figure 5:
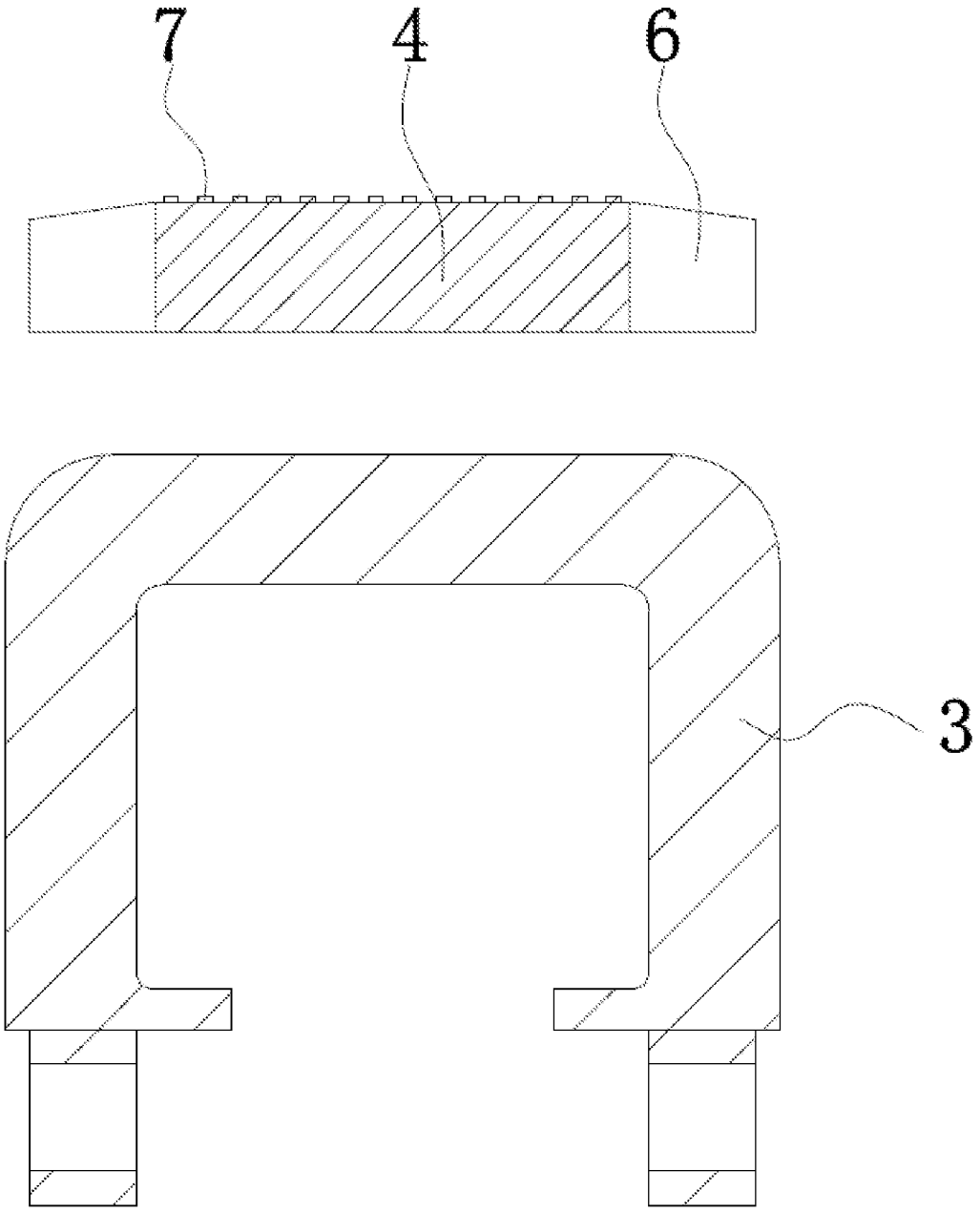
FIG. 5 is a structural schematic diagram of the connecting device of the present invention.
Figure 6:
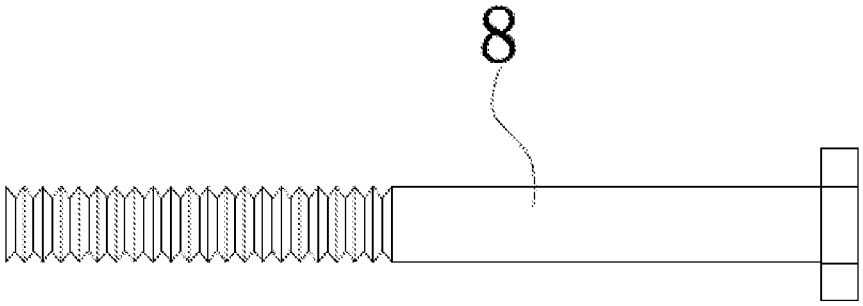
FIG. 6 is a structural schematic diagram of the bolt in the present invention.
Figure 7:
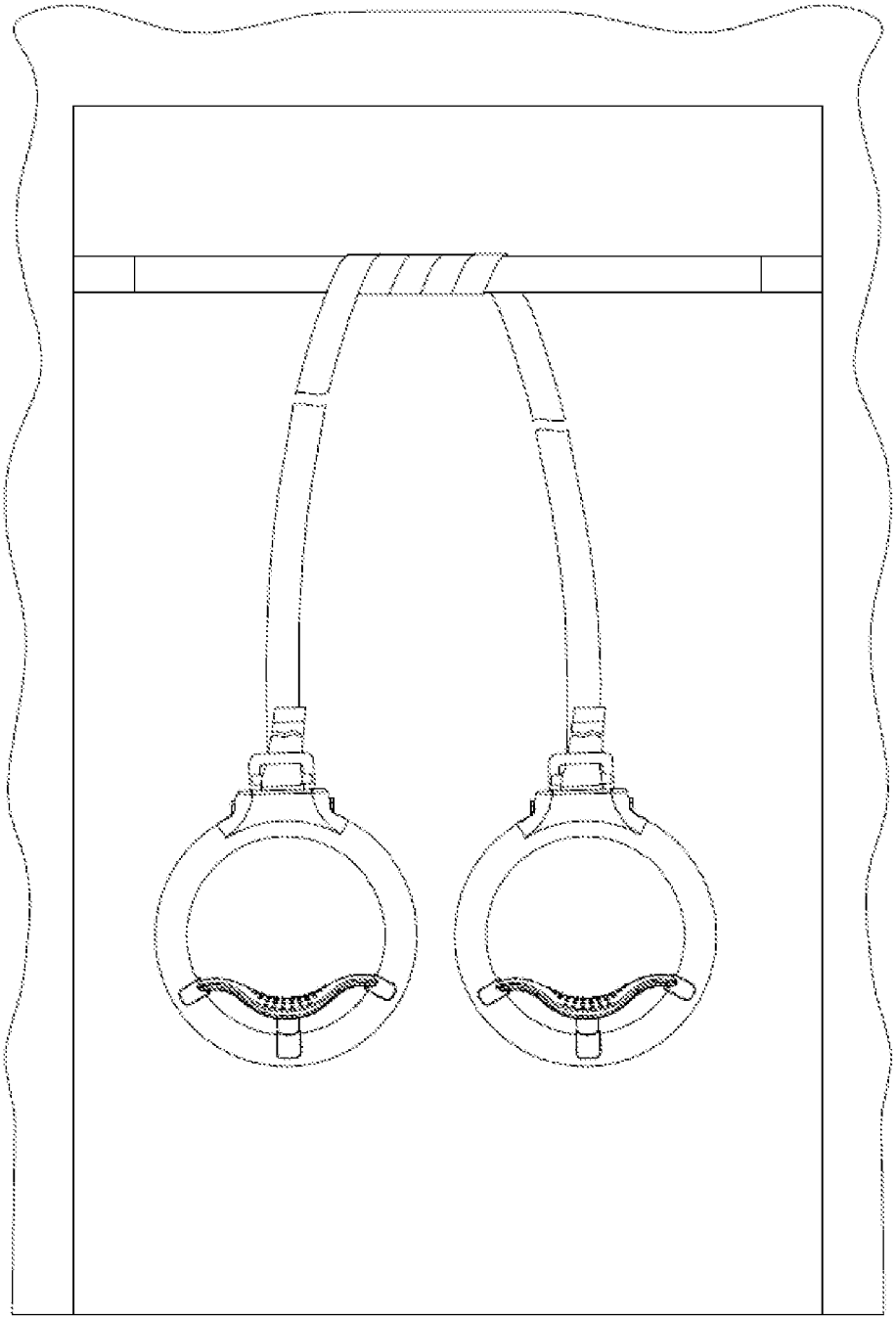
FIG. 7 is a structural schematic diagram of the present invention wound around an upper bar on the door.
Figure 8:
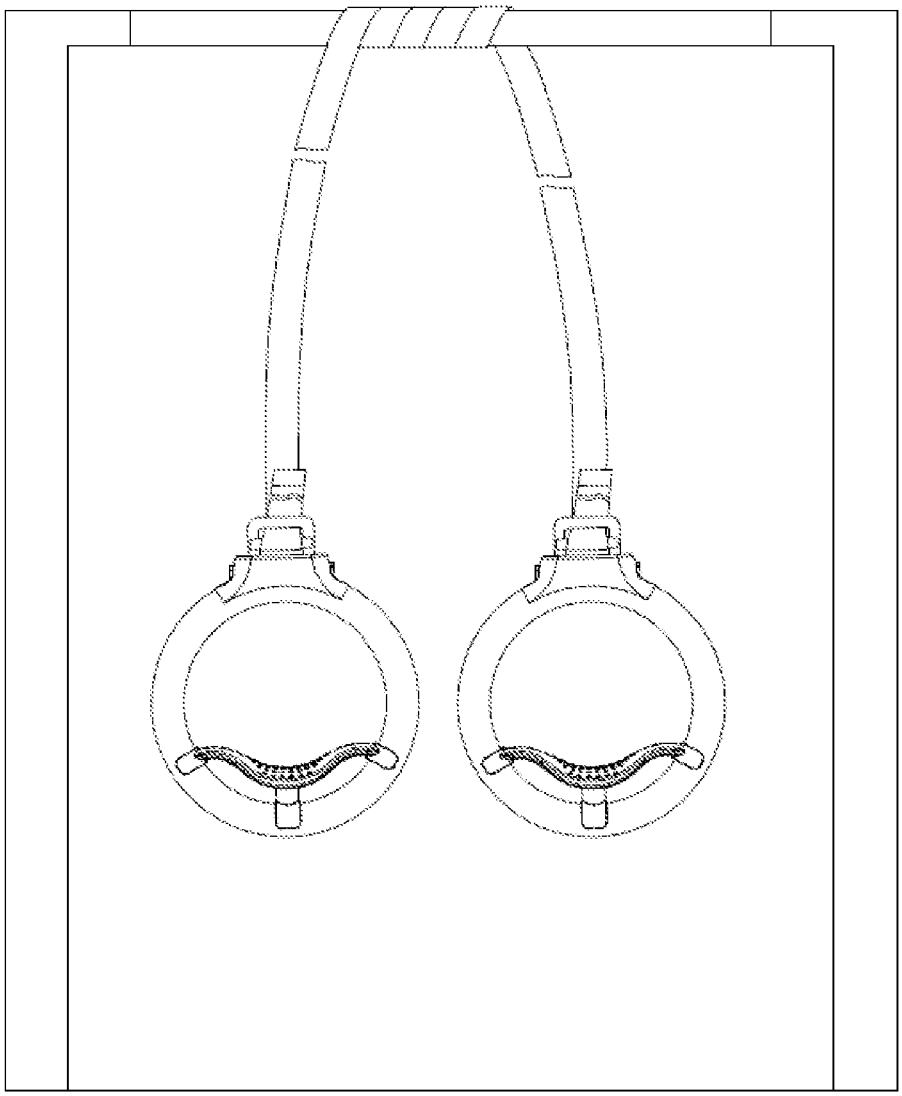
FIG. 8 is a structural schematic diagram of the present invention wound around uneven bars.
Figure 9:
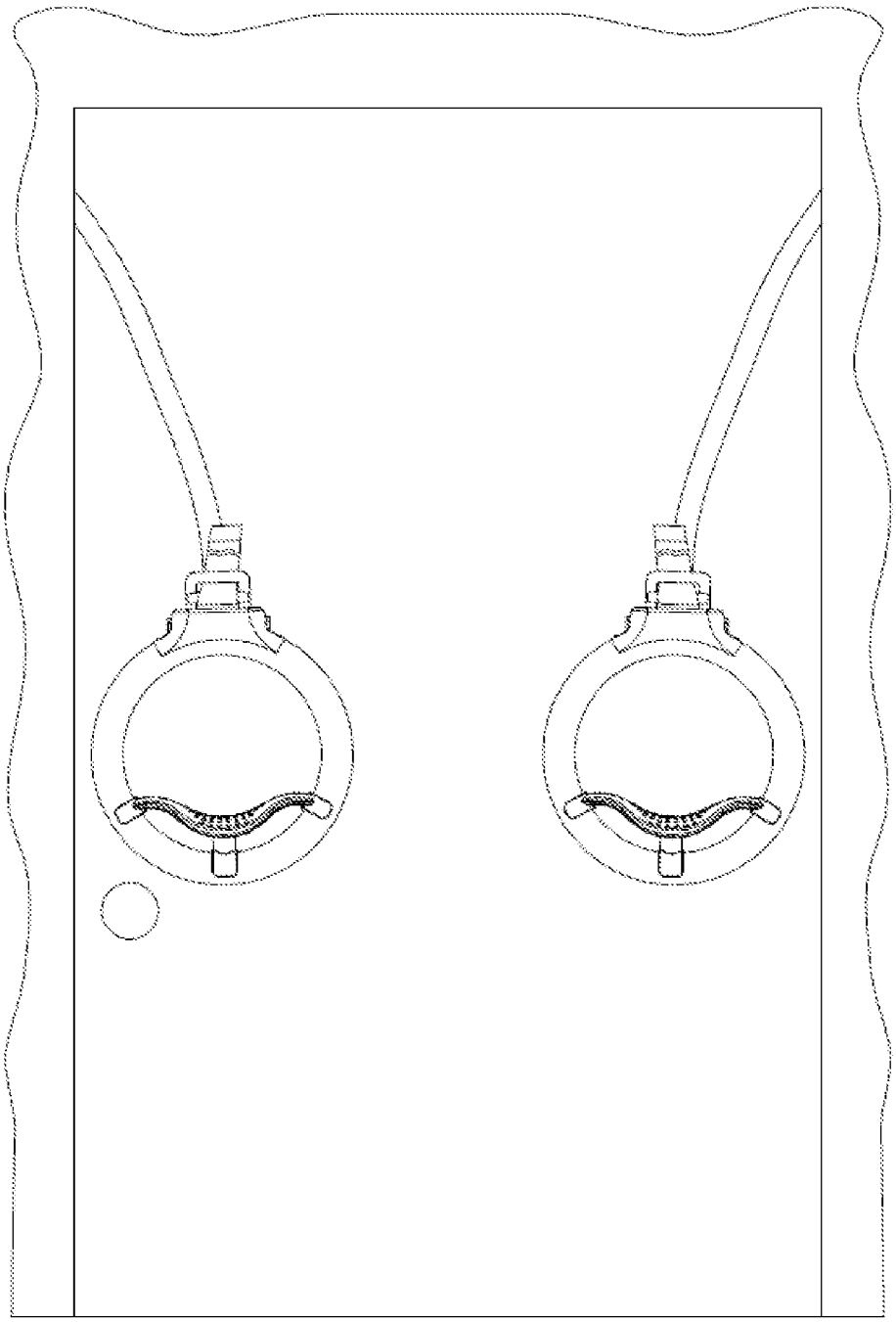
FIG. 9 is a structural schematic diagram of the present invention wound between the door and the door frame.
Figure 10:
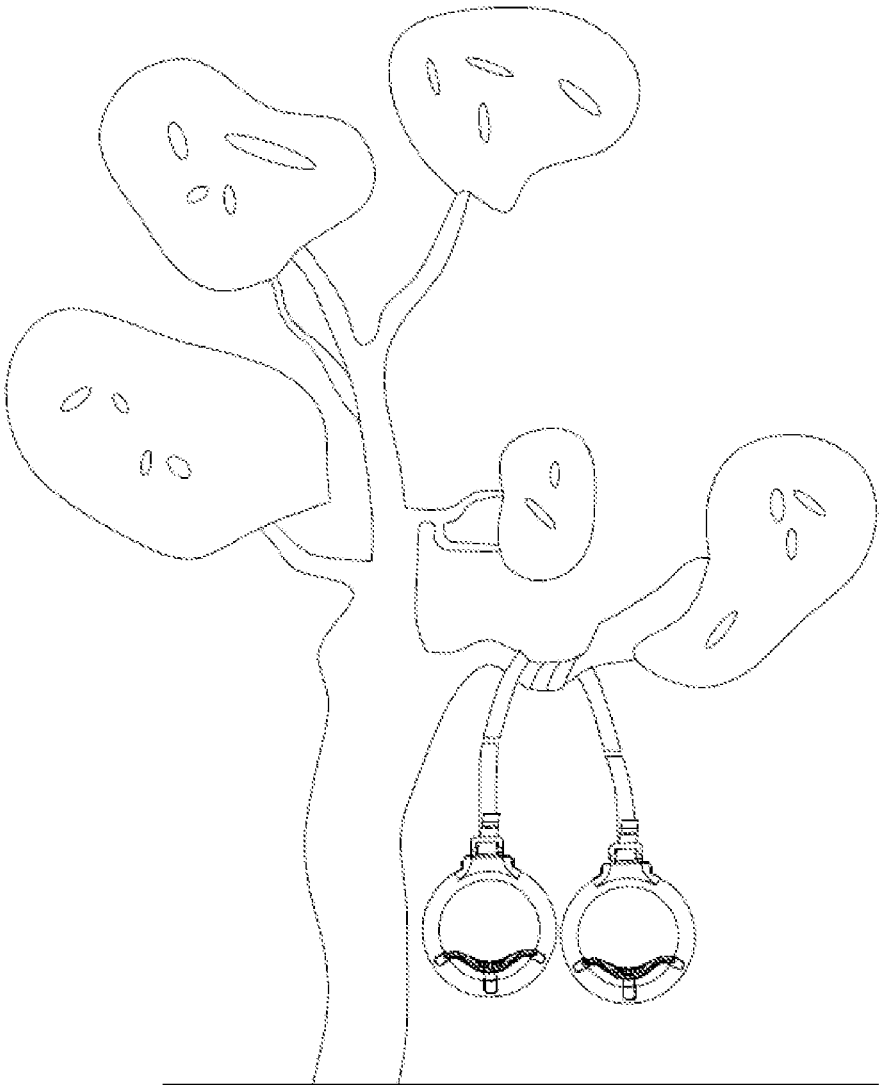
FIG. 10 is a structural schematic diagram of the present invention wound around a tree branch.
Figure 11:
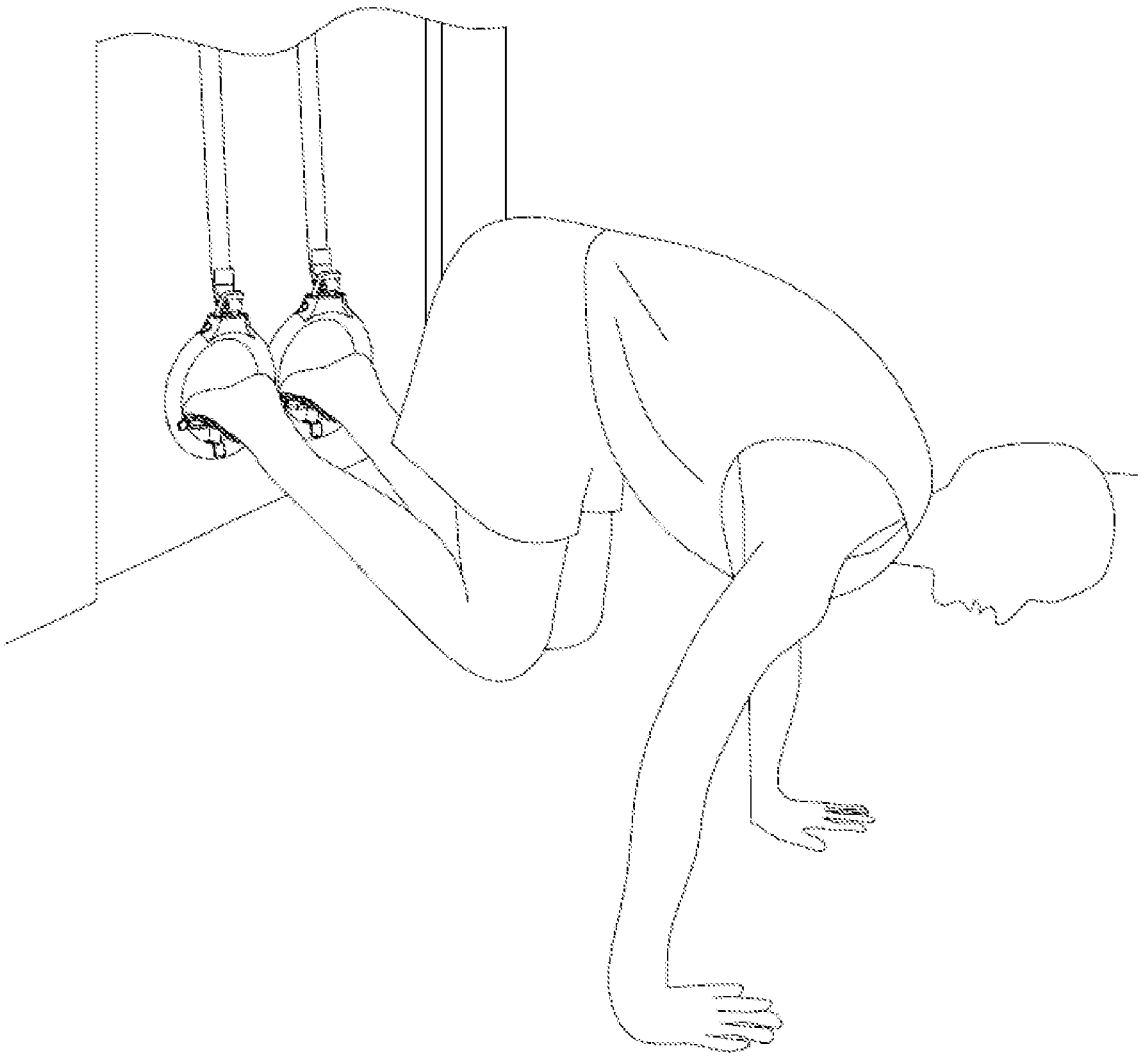
FIG. 11 is a structural schematic diagram of the present invention wound around the upper bar of the door for performing prone leg curls.
Figure 12:
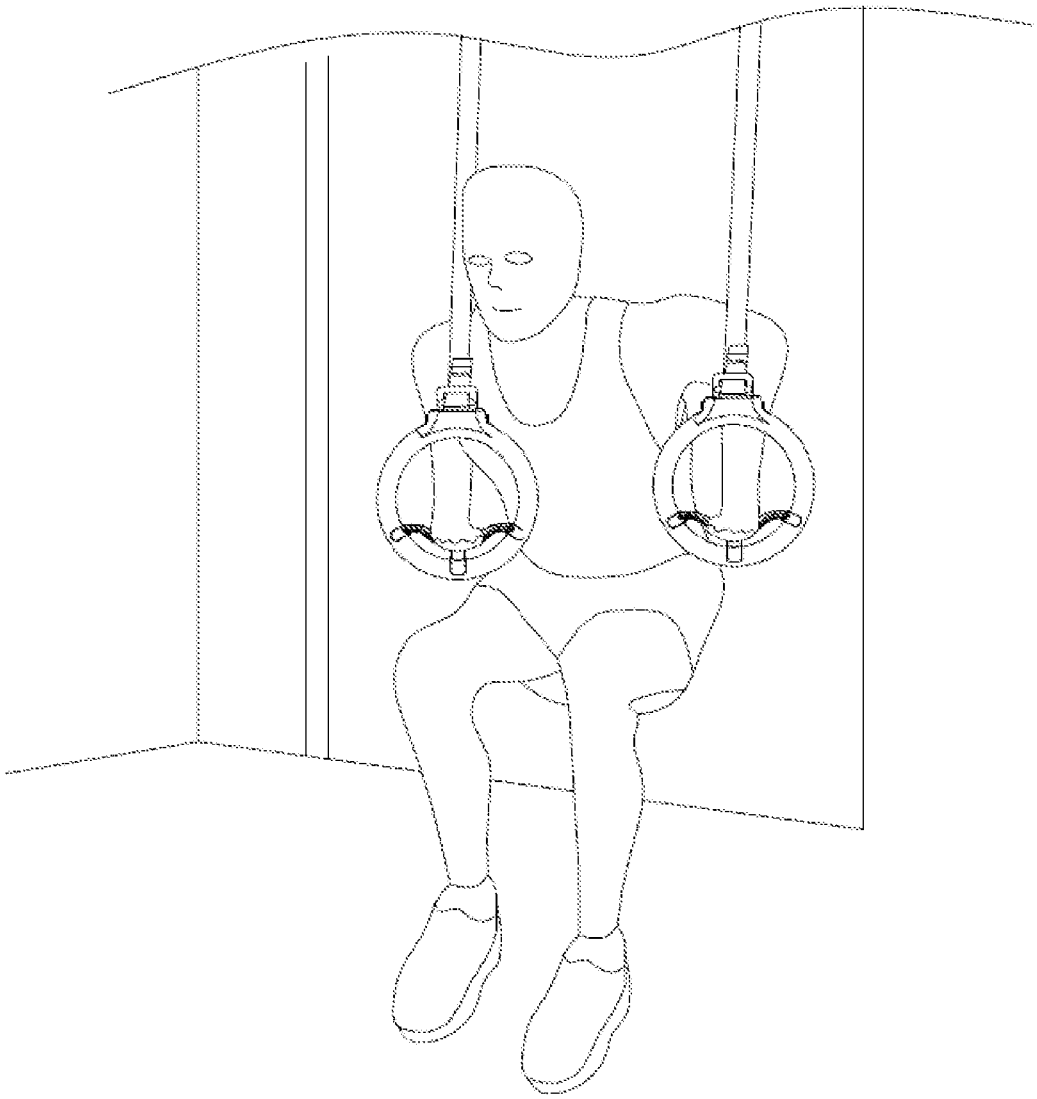
FIG. 12 is a structural schematic diagram of the present invention wound around the upper bar of the door for performing gymnastic pull-ups.
Figure 13:
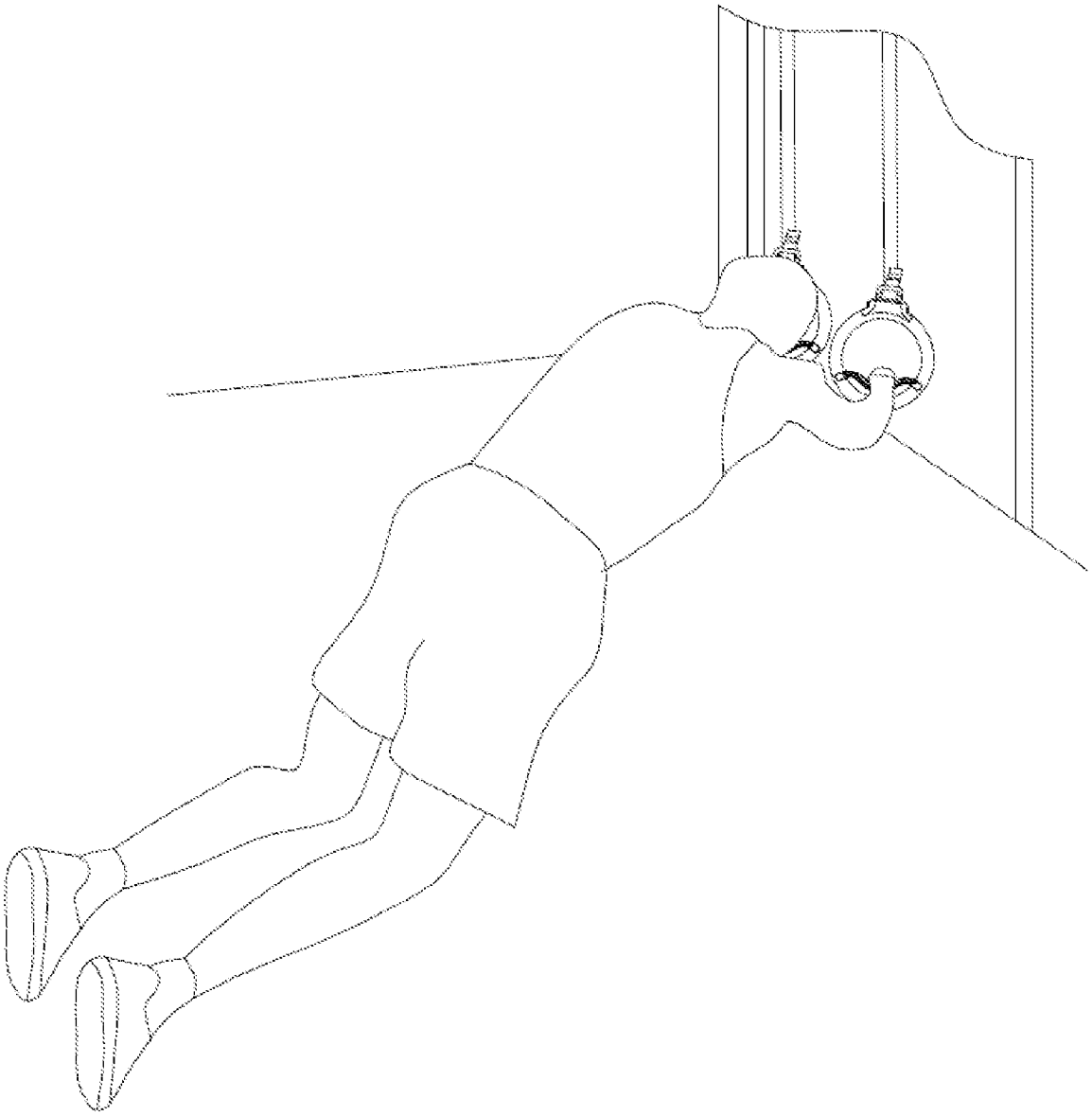
FIG. 13 is a structural schematic diagram of the present invention wound around the upper bar of the door for performing kneeling crunches.
Figure 14:
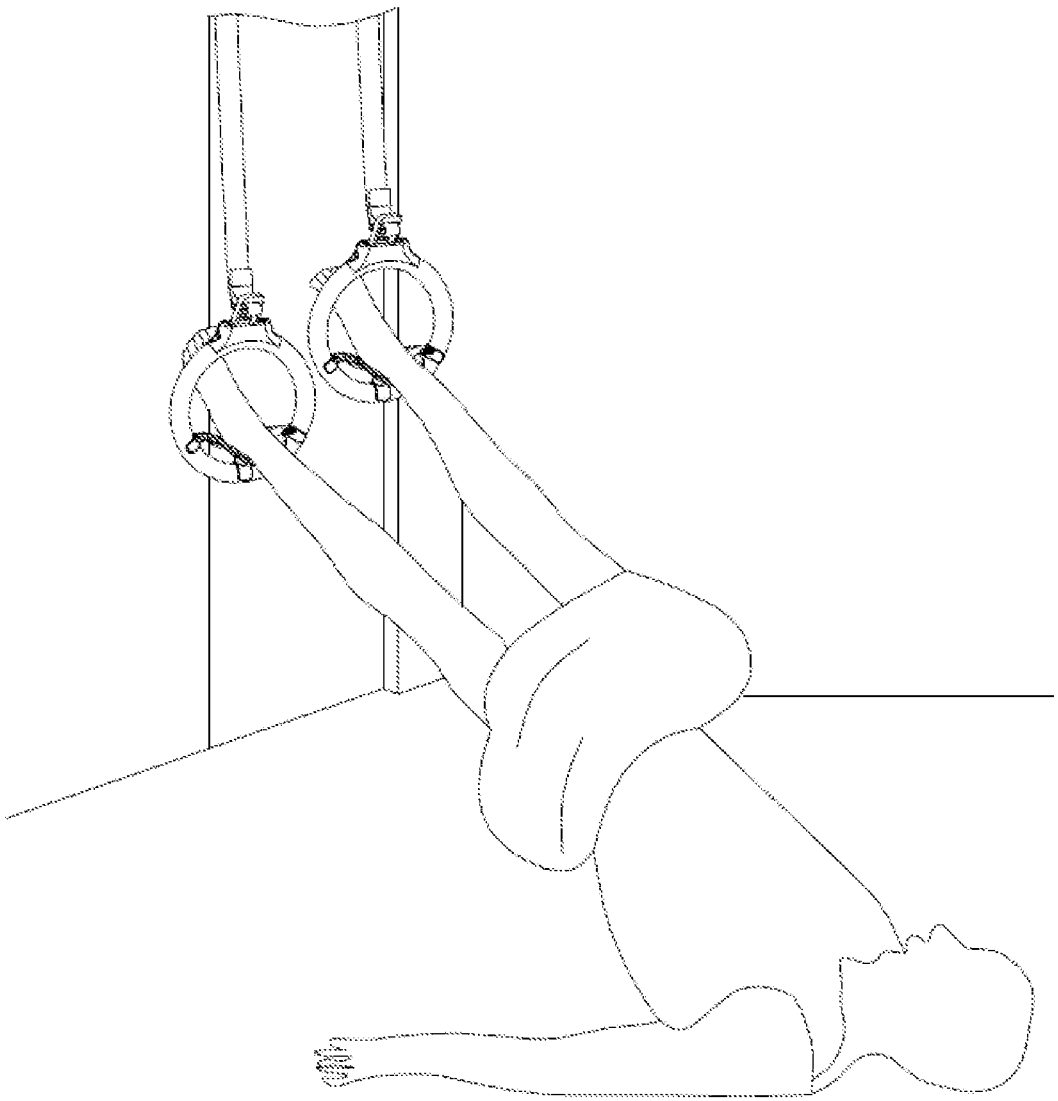
FIG. 14 is a structural schematic diagram of the present invention wound around the upper bar of the door for performing supine leg curls.
Figure 15:
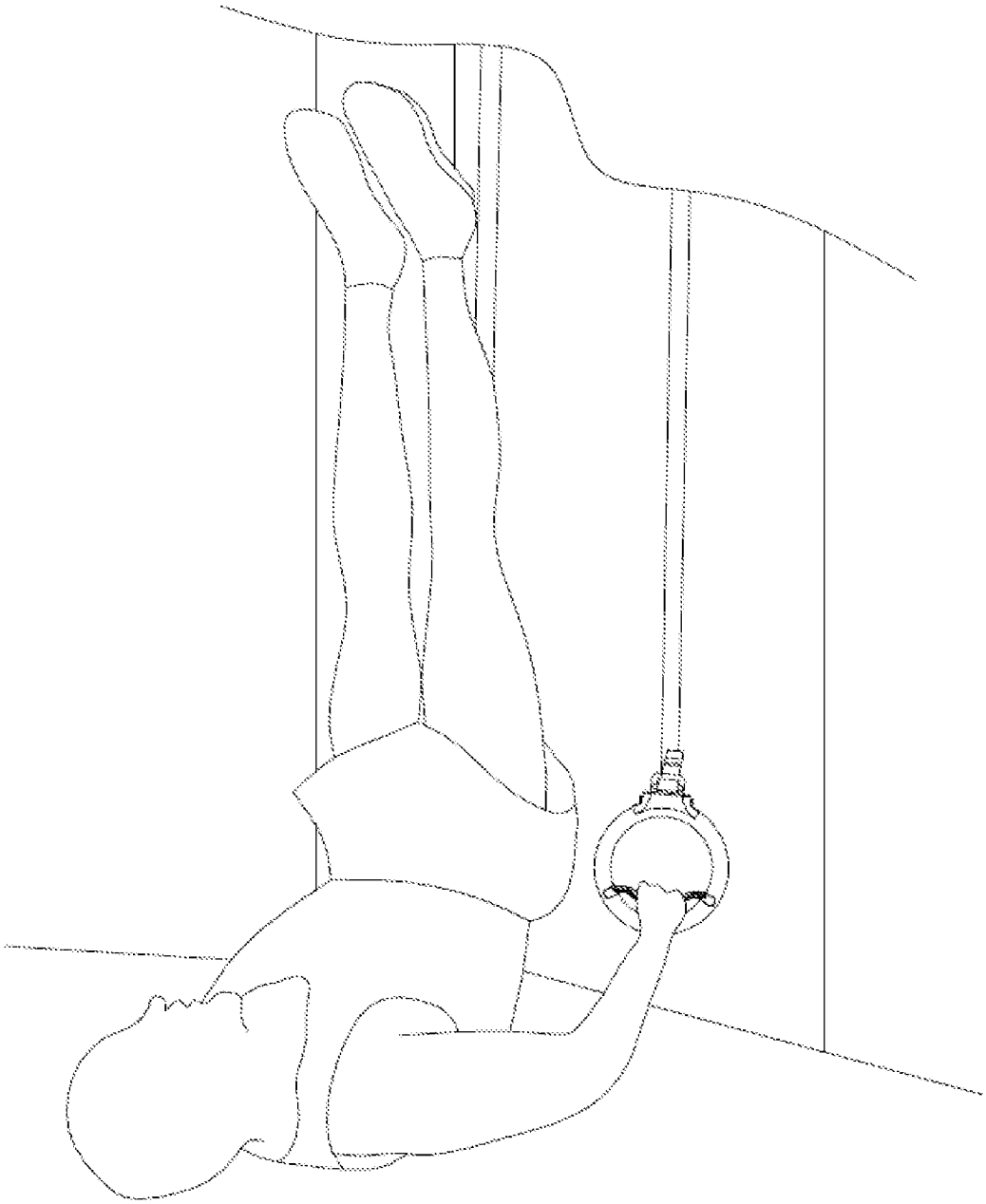
FIG. 15 is a structural schematic diagram of the present invention wound around the upper bar of the door for performing leg raises.

Referring to FIGS. 1-15, the present embodiment adopts the following technical solutions.

A training apparatus includes two ring bodies 1 for supporting the feet or hands of the human body and the belt 2. The ring bodies 1 are detachably arranged at both ends of the belt 2 through a connecting device. The connecting device includes the adjusting frame 3 that is arranged on the ring body 1 and configured for the belt 2 to pass therethrough, and the limiting rod 4 that is movably arranged on the adjusting frame 3 and configured to limit the belt 2 with an adjusted length. Each of both sides of the limiting rod 4 is provided with the U-shaped sliding groove 5 or the sliding protrusion 6, and the limiting rod 4 is slidably arranged on the adjusting frame 3 through the U-shaped sliding groove 5 or the sliding protrusion 6 on both sides. The limiting rod 4 is provided with limiting teeth 7 for retaining the adjusted belt 2. The lower part of the adjusting frame 3 is threadedly connected to the upper part of the ring body 1 through the bolt 8, and the bolt 8 is mated with a nut (not shown). Each of the ends of the belt 2 is bent to form the limiting end 9, and the limiting end 9 is sewn with the belt 2. The clamping edge 10 for clamping the upper part of the adjusting frame 3 is formed between the end of the limiting end 9 and the belt 2. A supporting device for supporting the feet or hands of the exerciser is detachably arranged on the inner ring of the ring body 1. The supporting device includes the supporting plate 11 for supporting the feet or hands of the human body, and the supporting plate 11 is provided with the clamping part 12 connected to the inner ring of the ring body 1. Each of the left side, the right side and the lower side of the supporting plate 11 is provided with the clamping part 12. The anti-slip part 13 is provided on the surface of the supporting plate 11. The supporting plate 11 is a flat plate or a downwardly concave arc-shaped supporting plate or an upwardly convex arc-shaped supporting plate.

The working principle of the present invention is as follows. One of the ring bodies 1 is connected to one end of the belt 2, and the adjusting frame 3 is threadedly connected to the upper part of the ring body 1 through the bolt 8. The supporting plate 11 is installed on the inner ring of the ring body 1 through the clamping part 12, and the limiting rod 4 is moved upward to the highest point through the U-shaped sliding groove 5 or the sliding protrusion 6. One end of the belt 2 passes through the opening between the lower part of the limiting rod 4 and the adjusting frame 3, and then the limiting rod 4 is moved downward a certain height through the U-shaped sliding groove 5 or the sliding protrusion 6. One end of the belt 2 passes through the opening between the upper part of the limiting rod 4 and the adjusting frame 3 in the reverse direction, and the passed length of the belt 2 is adjusted. Then, the limiting rod 4 is moved upward through the U-shaped sliding groove 5 or the sliding protrusion 6 to limit one end of the belt 2. The limiting teeth 7 on the limiting rod 4 retain the adjusted belt 2, and the limiting end 9 cooperates with the clamping edge 10 to clamp the upper part of the adjusting frame 3. The corresponding installation of the other ring body 1 is similar in principle to the above.

The basic principles, main features and advantages of the present invention are shown and described above. Those skilled in the art should understand that the present invention is not limited by the above-mentioned embodiments. The above-mentioned embodiments and descriptions describe only the principle of the present invention. The present invention will have various changes and improvements without departing from the spirit and scope of the present invention, and these changes and improvements shall fall within the scope claimed by the present invention. The scope of protection claimed by the present invention is defined by the appended claims and their equivalents. Those not described in detail in the present invention are the well-known technology for those skilled in the art.

What is claimed is:

1. A flying ring for fitness exercise, comprising
a ring body for supporting feet or hands of a human body;
wherein an upper part of the ring body is provided with a connecting device connected to an external belt;
the connecting device comprises an adjusting frame and a limiting rod, wherein
the adjusting frame is arranged on the ring body and the external belt passes through the adjusting frame,
the limiting rod is movably arranged on the adjusting frame and configured to limit the external belt with an adjusted length; and
the limiting rod is provided with limiting teeth for retaining the external belt with the adjusted length.

2. The flying ring according to claim 1, wherein,
a supporting device for supporting the feet or the hands of the human body is detachably arranged on an inner ring of the ring body.

3. The flying ring according to claim 2, wherein,
the supporting device comprises a supporting plate for supporting the feet or the hands of the human body, and the supporting plate is provided with a clamping part connected to the inner ring of the ring body.

4. The flying ring according to claim 3, wherein,
the supporting plate is a flat plate or a downwardly concave arc-shaped supporting plate or an upwardly convex arc-shaped supporting plate.

5. The flying ring according to claim 3, wherein,
an anti-slip part is provided on a surface of the supporting plate.

6. The flying ring according to claim 1, wherein,
each of both sides of the limiting rod is provided with a U-shaped sliding groove or a sliding protrusion, and the limiting rod is slidably arranged on the adjusting frame through the U-shaped sliding groove or the sliding protrusion on the both sides of the limiting rod.

7. A flying ring for fitness exercise, comprising
a ring body for supporting feet or hands of a human body;
wherein an upper part of the ring body is provided with a connecting device connected to an external belt;
the connecting device comprises an adjusting frame and a limiting rod, wherein
the adjusting frame is arranged on the ring body and the external belt passes through the adjusting frame,
the limiting rod is movably arranged on the adjusting frame and configured to limit the external belt with an adjusted length; and
a lower part of the adjusting frame is threadedly connected to the upper part of the ring body through a bolt.

8. A training apparatus, comprising two ring bodies for supporting feet or hands of a human body and a belt; wherein the two ring bodies are detachably arranged at both ends of the belt;
the two ring bodies are detachably arranged at the both ends of the belt through a connecting device;
the connecting device comprises an adjusting frame and a limiting rod, wherein
the adjusting frame is arranged on the each ring body and the belt passes through the adjusting frame,
the limiting rod is movably arranged on the adjusting frame and configured to limit the belt with an adjusted length, and
the limiting rod is provided with limiting teeth for retaining the belt with the adjusted length.

9. The training apparatus according to claim 8, wherein,
a supporting device for supporting the feet or the hands of the human body is detachably arranged on an inner ring of each ring body of the two ring bodies.

10. The training apparatus according to claim 9, wherein,
the supporting device comprises a supporting plate for supporting the feet or the hands of the human body, and the supporting plate is provided with a clamping part connected to the inner ring of the each ring body.

11. The training apparatus according to claim 10, wherein,
each of a left side, a right side and a lower side of the supporting plate is provided with the clamping part.

12. The training apparatus according to claim 10, wherein,
the supporting plate is a flat plate or a downwardly concave arc-shaped supporting plate or an upwardly convex arc-shaped supporting plate.

13. The training apparatus according to claim 10, wherein,
an anti-slip part is provided on a surface of the supporting plate.

14. The training apparatus according to claim 8, wherein,
each of both sides of the limiting rod is provided with a U-shaped sliding groove or a sliding protrusion, and the limiting rod is slidably arranged on the adjusting frame through the U-shaped sliding groove or the sliding protrusion on the both sides of the limiting rod.

15. The training apparatus according to claim 8, wherein,
a lower part of the adjusting frame is threadedly connected to an upper part of the each ring body through a bolt.

16. The training apparatus according to claim 8, wherein,
each of the both ends of the belt is bent to form a limiting end, the limiting end is sewn with the belt, and a clamping edge for clamping an upper part of the adjusting frame is formed between an end of the limiting end and the belt.

* * * * *